US006240600B1

(12) United States Patent
Petruska, Jr.

(10) Patent No.: US 6,240,600 B1
(45) Date of Patent: Jun. 5, 2001

(54) METHOD AND APPARATUS FOR COVERING A HAND TOOL

(76) Inventor: John J. Petruska, Jr., 2914 Hiawatha St., New Orleans, LA (US) 70126

( * ) Notice: Subject to any disclaimer, the term of this patent is extended or adjusted under 35 U.S.C. 154(b) by 0 days.

(21) Appl. No.: 09/386,019

(22) Filed: Aug. 30, 1999

(51) Int. Cl.[7] ..... B25G 1/00
(52) U.S. Cl. ..... 16/421; 16/431
(58) Field of Search ..... 16/110.1, 430, 16/431, 421, 422; 81/177.1, 177.4, 489, 124.3, 124.7

(56) References Cited

U.S. PATENT DOCUMENTS 4,372,361 * 2/1983 Whiteford ..... 81/177.4
4,934,024 6/1990 Sexton, I .
4,941,232 * 7/1990 Decker et al. ..... 16/421
4,981,737 1/1991 Rico .
4,986,147 * 1/1991 Cooper ..... 16/431
5,097,566 3/1992 Decker et al. .
5,280,735 1/1994 Kuipers et al. .
5,325,737 7/1994 Bendetti .
5,692,265 12/1997 Dalury .

* cited by examiner

*Primary Examiner*—Anthony Knight
*Assistant Examiner*—Robert J. Sandy
(74) *Attorney, Agent, or Firm*—Kenneth L Tolar

(57) ABSTRACT

A unitary shell for encasing a hand tool includes an elongated hollow tubular sleeve having an open upper end for receiving and conforming to a tool handle. The upper end of the tubular sleeve includes a head portion which may be wrapped about a tool head. The shell allows a user to selectively cover a hand tool to minimize damage to surrounding objects if the tool collides therewith.

5 Claims, 1 Drawing Sheet

METHOD AND APPARATUS FOR COVERING A HAND TOOL

BACKGROUND OF THE INVENTION

The present invention relates to a protective shell for completely encasing a hand tool to minimize damage to surrounding objects if the tool collides therewith.

DESCRIPTION OF THE PRIOR ART

Metal tools such as ratchet wrenches and similar items must often be manipulated within confined spaces or near various objects. As a result, the tool sometimes strikes surrounding objects causing significant damage thereto. Furthermore, conventional metallic hand held tools are often slippery especially if the user is perspiring. The present invention relates to a rubber shell configured to completely encase and conform to a hand tool. The sleeve provides the tool with a softer exterior surface thereby minimizing its impact with other objects. In addition, the sleeve provides a more comfortable, slip resistant gripping surface.

Various tool covers exist in the prior art. For example, U.S. Pat. No. 4,934,024 issued to Sexton relates to a grip comprised of a deformable cover formed of a thermoplastic material. The device is heated allowing a user to mold the cover to the shape of the user's hand.

U.S. Pat. No. 5,097,566 issued to Decker et al relates to a slip-resistant cushioning covers for handles formed of an elastomeric tube having at least one open end with ribs on the exterior surface thereof.

U.S. Pat. No. 4,981,737 issued to Rico relates to a vibration damping wrap for a tool handle.

U.S. Pat. No. 5,280,735 issued to Kuipers et al relates to a two piece slip-resistant grip including a pliable inner sleeve and a substantially rigid outer housing.

U.S. Pat. No. 5,325,737 issued to Bendetti relates to a cover for levers including a single strand of leather.

U.S. Pat. No. 5,692,265 issued to Dalury relates to a ergonometric handle that is shaped to encourage a natural working grip.

Although various tool covers exist, all are designed to cover only the handle portion of the tool to provide a more comfortable gripping surface. The present invention, however, is designed to encase substantially the entire tool so as to minimize damage to objects that the tool inadvertently strikes.

SUMMARY OF THE INVENTION

The present invention relates to a shell for encasing a hand tool. The shell comprises an elongated hollow tubular sleeve for receiving and encasing a tool handle. The tubular sleeve includes an open top end and a closed bottom end. At the top end of the tubular sleeve is a head portion for covering a substantial portion of a tool head. The shell is applied to the tool by inserting the tool handle into the tubular sleeve and then wrapping the head portion about the tool head. When installed on a tool, the unitary shell substantially covers the entire tool thereby minimizing damage to surrounding objects should the tool collide therewith. It is therefore an object of the present invention to provide a tool cover that may be quickly and easily applied to a tool.

It is another object of the present invention to provide a tool cover that minimizes damage to objects that the tool inadvertently engages.

It is yet another object of the present invention to provide a hand tool cover that provides a comfortable slip resistant gripping surface. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
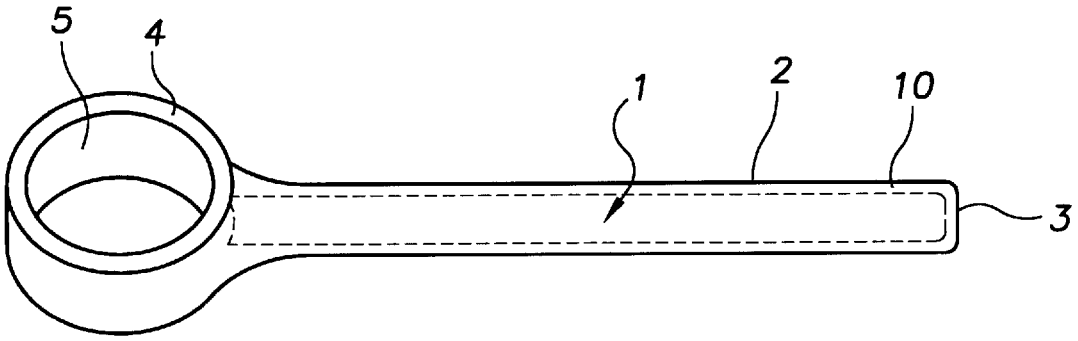
FIG. 1 depicts a sleeve according to the present invention.
Figure 2:
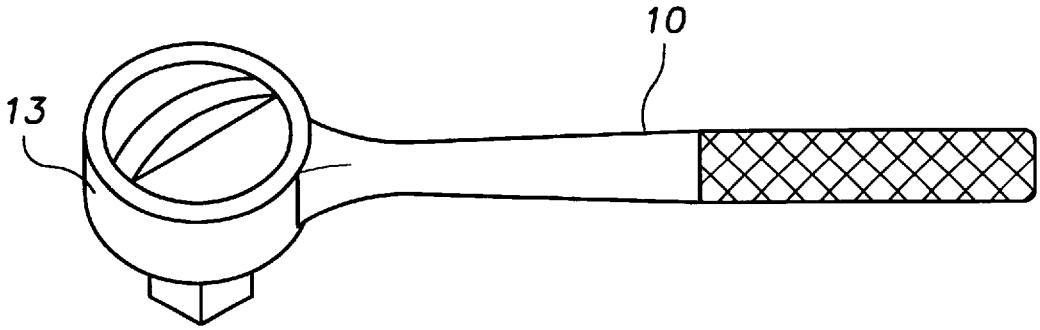
FIG. 2 depicts a ratchet wrench to which the sleeve depicted in FIG. 1 may be applied.
Figure 3:
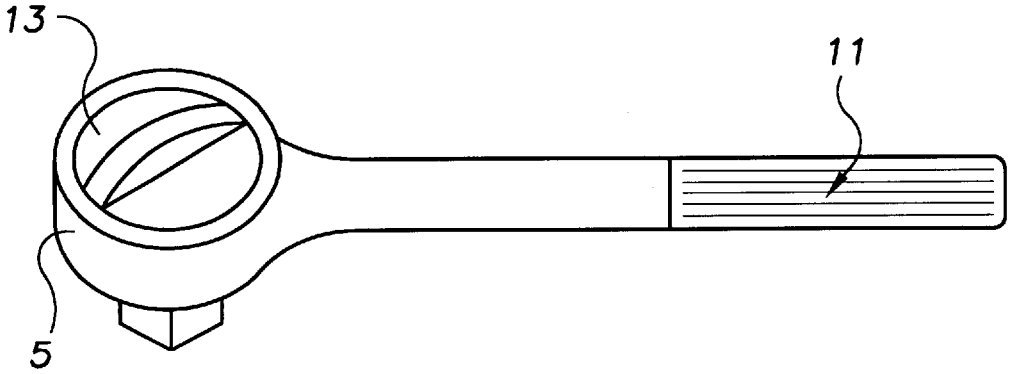
FIG. 3 depicts the sleeve attached to the wrench.

Referring now to FIGS. 1 through 3, the present invention relates to a unitary shell 1 for encasing a hand tool. The shell comprises an elongated, hollow tubular sleeve 2 having a closed lower end 3 and an open upper end 4. The tubular sleeve is dimensioned and configured to receive and completely conform to a tool handle 10. Integrally extending from the upper end of the tubular sleeve is a head portion 5. In the preferred embodiment, the head portion is a substantially circular ring or collar for completely overlaying and surrounding the outer wall of a ratchet wrench head 13. However, as will be readily apparent to those skilled in the art, the head portion may be configured to completely overlay and conform to a variety of other tool heads such as conventional monkey wrenches and similar tools. The tubular handle portion also includes a plurality of longitudinally disposed grooves 11 for providing a slip resistant gripping surface.

To attach the above described shell to a hand tool, the tool handle is inserted into the tubular sleeve through the open upper end 4 until the tool handle is completely disposed within the sleeve. The head portion of the shell is then wrapped about the ratchet head and the tool is used in a typical fashion. In addition, the shell may be permanently secured to the tool using a silicone adhesive or similar substance or the device may be temporarily attached allowing the shell to be removed if desired.

The above described shell is preferably constructed with rubber or similar material. However, as will be apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cover for a hand tool, comprising:

a unitary shell including an elongated tubular sleeve having a closed lower end and an open upper end for receiving and conforming to a tool handle;

a head portion integrally extending from the upper end of said elongated tubular sleeve for overlaying a substantial portion of a tool head.

2. A cover for a hand tool according to claim 1 wherein said head portion includes a substantially circular collar for peripherally bordering a ratchet wrench head.

3. A cover for a hand tool according to claim 1 wherein said tubular sleeve includes an exterior surface having a plurality of longitudinal grooves thereon for providing a slip resistant gripping surface.

4. A cover for a hand tool according to claim 1 wherein said shell is constructed with rubber.

5. A method for covering a hand tool comprising the steps of:

providing a unitary shell having an elongated hollow tubular sleeve with an open end and a head portion at the open end, said head portion configured to overlay a substantial portion of a tool head;

inserting a tool handle into said sleeve until said sleeve encompasses substantially all of said tool handle;

wrapping the head portion about a tool head.

* * * * *